US007250689B2

(12) United States Patent
Koerner et al.

(10) Patent No.: US 7,250,689 B2
(45) Date of Patent: Jul. 31, 2007

(54) COMMON COMPOSITION ENGINE CONTROL UNIT AND VOLTAGE REGULATOR

(75) Inventors: Scott A. Koerner, Kenosha, WI (US); Michael J. French, Pleasant View, WI (US); Mark J. Skrzypchak, Pleasant Prairie, WI (US); Dale A. Wiegele, Kenosha, WI (US); Matthew J. Edwards, Pleasant Prairie, WI (US); Gregry M. Remmers, Ingleside, IL (US)

(73) Assignee: BRP US Inc., Sturtevant, WI (US)

( * ) Notice: Subject to any disclaimer, the term of this patent is extended or adjusted under 35 U.S.C. 154(b) by 14 days.

(21) Appl. No.: 11/379,547

(22) Filed: Apr. 20, 2006

(65) Prior Publication Data

US 2006/0237971 A1 Oct. 26, 2006

Related U.S. Application Data

(63) Continuation of application No. 10/708,063, filed on Feb. 6, 2004, now abandoned.

(51) Int. Cl.
*F02N 11/06* (2006.01)

(52) U.S. Cl. ..... 290/41; 290/44 C; 290/40 B; 322/36; 322/20; 322/37; 123/478

(58) Field of Classification Search ..... 290/41; 322/36, 20, 37; 123/478
See application file for complete search history.

(56) References Cited

U.S. PATENT DOCUMENTS

| | | | | |
|---|---|---|---|---|
| 4,137,871 | A * | 2/1979 | Martel et al. | 123/491 |
| 4,418,673 | A * | 12/1983 | Tominari et al. | 123/478 |
| 4,557,225 | A * | 12/1985 | Sagues et al. | 123/41.31 |
| 4,955,340 | A * | 9/1990 | Elliott | 123/297 |
| 5,207,186 | A * | 5/1993 | Okita | 123/41.31 |
| 6,446,593 | B1 * | 9/2002 | Suganuma | 123/198 D |
| 6,557,509 | B1 * | 5/2003 | Hall et al. | 123/179.16 |

* cited by examiner

*Primary Examiner*—Darren Schuberg
*Assistant Examiner*—Iraj Mohandesi
(74) *Attorney, Agent, or Firm*—Osler, Hoskin & Harcourt LLP

(57) ABSTRACT

A control unit assembly is disclosed including a housing, at least one processor to control operation of an engine, and a voltage regulator configured to regulate a voltage of at least one rail of the engine. The at least one processing unit and the voltage regulator reside on a common circuit board.

10 Claims, 2 Drawing Sheets

COMMON COMPOSITION ENGINE CONTROL UNIT AND VOLTAGE REGULATOR

BACKGROUND OF INVENTION

The present invention relates generally to electronic management modules and, more particularly, to those used with internal combustion engines of recreational products.

The electrical operations of an internal combustion engine are, for the most part, controlled by an electronic control unit, hereinafter, an ECU. The ECU includes a wide variety of the electrical controls necessary to operate an engine. These controls can monitor and control various aspects of engine operation including ignition, engine timing, emission systems, air and fuel systems, and temperature sensors, to name but a few.

Depending on engine performance, emission control requires more and more circuitry and/or controls on board such as ECUs. Additionally, advancements in electronic technologies have resulted in increased processing capabilities. As such, ECUs have advanced to control, regulate, and monitor more and more engine systems and properties. However, there remain some engine systems that the ECU is not suited to independently control and regulate, such as high voltage systems requiring voltage regulation.

Modern engines have a variety of needs that can benefit from a high voltage operating environment. While it is possible to provide these higher level voltages, such increased operating voltages cannot always be readily utilized by some engine components and, therefore, regulation and conditioning is required before being delivered to various engine systems. Furthermore, different engine components and systems may have different power consumption requirements and ideal power ranges within which the components and systems operate most efficiently. As such, it is often advantageous to include multiple power or voltage regulators/conditioners such that an ideal power with an ideal voltage is delivered to each of the various engine components and systems.

However, the recreational products industry is one in which size, packaging, and weight are all at the forefront of the design process. As such, having separate devices located at different locations is not just time consuming to install and wire, it reduces available space and increases overall cost. Therefore, having an ECU and various power regulators/conditioners separately mounted and wired throughout the engine is contrary to these objectives.

Additionally, it is ideal that the ECU and the power or voltage regulators/conditioners be disposed within a housing to protect the electrical components from the operating environment. However, the housings, while necessary to protect the components, adds to the size of the ECU and each power or voltage regulator/conditioner. Again, this serves contrary to the objective of minimizing the size, packaging, and weight of the recreational product engine.

It would therefore be desirable to have system whereby the ECU and power or voltage regulator/conditioner requirements of a recreational product are combined. Furthermore, it would be desirable that these requirements be met while minimizing the size, packaging, and weight of the recreational product.

BRIEF DESCRIPTION OF INVENTION

The present invention provides a system that overcomes the aforementioned drawbacks. The present invention provides a common circuit board engine control unit (ECU) and power and/or voltage regulator/conditioner. The circuit board ECU and power and/or voltage regulator/conditioner are secured within a single housing to form a compact engine management module (EMM) that meets the objectives of stringent size, packaging, and weight requirements of modern recreational products.

Therefore, in accordance with one aspect of the present invention, a control unit assembly is disclosed that includes a housing, at least one processor to control operation of an engine, and a voltage regulator configured to regulate a voltage of at least one rail of the engine. The at least one processing unit and the voltage regulator reside on a common circuit board.

According to another aspect of the present invention, an engine management module (EMM) is disclosed that includes an engine control unit (ECU) mounted on a circuit board and configured to control a plurality of systems of a recreational product engine and a voltage regulator mounted on the circuit board and configured to regulate a voltage supplied to at least a number of the plurality of systems of the recreational product engine.

According to yet another aspect of the present invention, an outboard motor is disclosed that includes a powerhead having a combustion engine, a midsection configured for mounting the outboard motor to a watercraft, and a lower unit powered by the combustion engine to propel a watercraft and an EMM assembly. The EMM assembly includes a circuit board, at least one processor controlling engine operation attached to the circuit board, and at least one voltage regulator attached to the circuit board.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
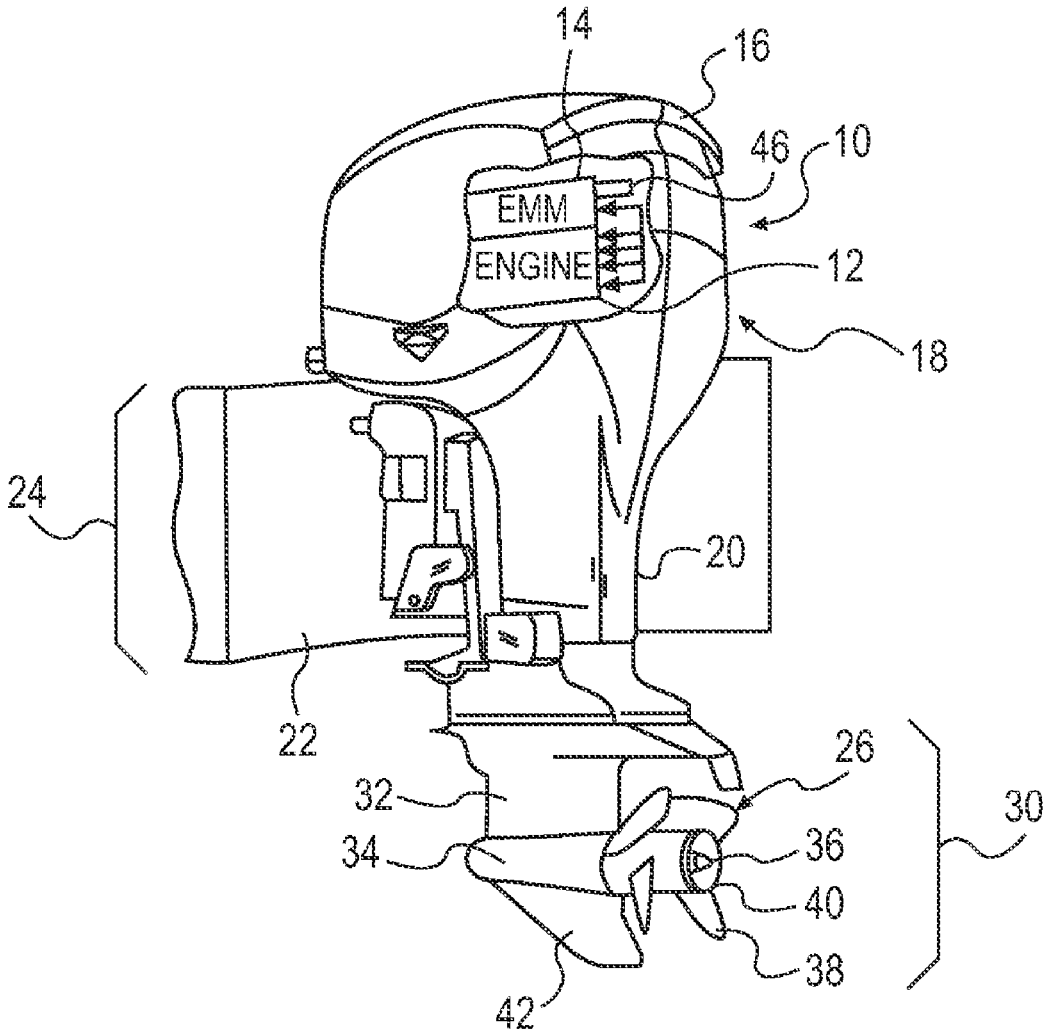
FIG. 1 is a perspective view of an exemplary outboard motor incorporating the present invention.

The present invention relates generally to electronic management modules (EMM), and preferably, those incorporated with internal combustion engines of outdoor recreational products. FIG. 1 shows an outboard motor 10 having an engine 12 controlled by an EMM module 14 under engine cover 16. Engine 12 is housed generally in a powerhead 18 and is supported on a mid-section 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 depends vertically downwardly from torpedo section 34 to protect propeller fins 38 and encourage the efficient flow of outboard motor 10 through water. For purposes of this invention, engine 12 may be either a two-cycle or a four-cycle engine.

EMM 14 is connected to a cooling loop 46 which circulates coolant into and through EMM 14. By providing a cooling loop 46 through EMM 14, EMM 14 can support electrical components which previously generated too much heat to be incorporated into the EMM 14. As such, more of the electrical controls of an engine can be incorporated in a single component. Additionally, cooling loop 46 could circulate coolant from a closed loop cooling system of engine 12 or independent therefrom, such as directly from a body of open water. Furthermore, the cooling flow through cooling loop 46 need not be limited to the water systems of the engine but could also in constructed to be in fluid communication with an oil or fuel system of the engine.

While the present invention is shown as being incorporated into a two-cycle engine of an outboard motor, the present invention is equally applicable with other engines and other recreational products, some of which include inboard motors, snowmobiles, personal watercrafts, all-terrain vehicles (ATVs), motorcycles, mopeds, power scooters, and the like.

It is understood that within the context of this application, the term "recreational product" is intended to define products incorporating an internal combustion engine that are not considered a part of the automotive industry. Within the context of this invention, the automotive industry is not believed to be particularly relevant in that the needs and wants of the consumer are radically different between the recreational products industry and the automotive industry. As is readily apparent, the recreational products industry is one in which size, packaging, and weight are all at the forefront of the design process, and while these factors may be somewhat important in the automotive industry, it is quite clear that these criteria take a back seat to many other factors, as evidenced by the proliferation of larger highway vehicles, such as sports utility vehicles (SUV).

Figure 2:
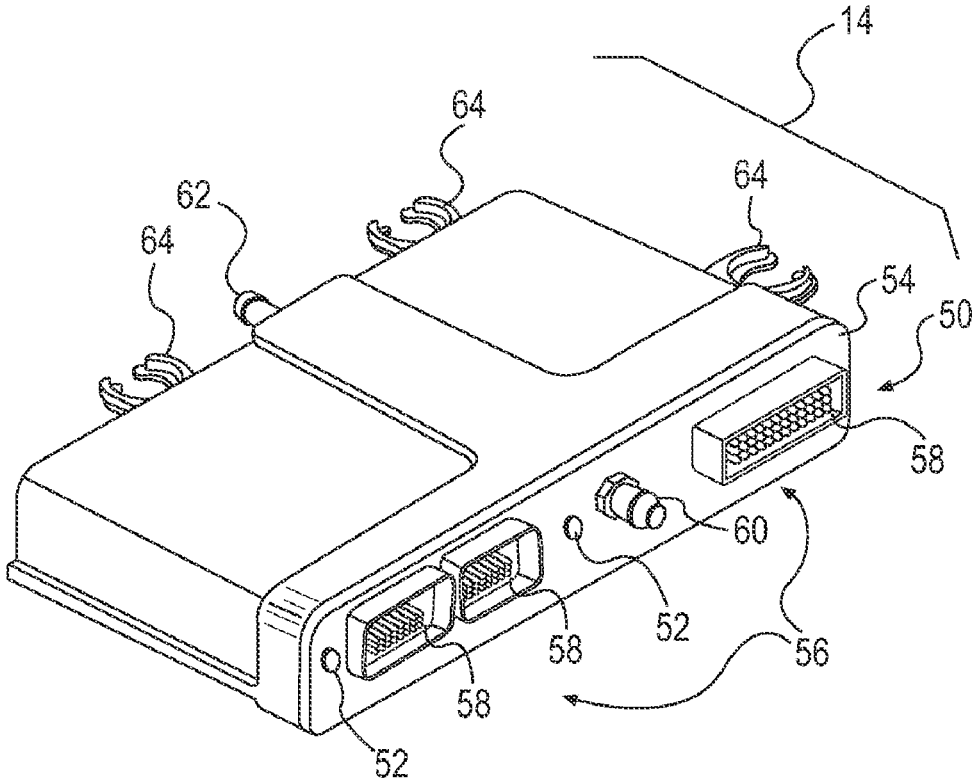
FIG. 2 is a perspective view of an EMM according to the present invention.

FIG. 2 shows EMM 14 removed from engine 12. EMM 14 includes a housing 48 constructed to receive an EMM assembly 50 therein. A pair of fasteners 52 secure a cover 54 about a communications array 56 of EMM assembly 50. Alternately, cover 54 may be a gel seal. Communications array 56 extends through cover 54 and includes a plurality of multi-pin connectors 58, 81. Multi-pin connectors 58, 81 provide the electrical connectively between EMM 14 and the systems and sensors of engine 12. It is understood that multi-pin connectors could have either a male or a female type engagement with an engine connector (not shown). It is also understood that each of the multi-pin connectors can be constructed to prevent interchangeability between the engine connectors. Such a construction allows EMM 14 to be installed relatively quickly while ensuring that each multi-pin connector is connected to the proper engine system.

An inlet connector 60 extends through cover 54 and an outlet connector 62 extends through housing 48. Inlet and outlet couplers 60, 62 allow the coolant path to continually circulate coolant through EMM 14 during operation of the recreational product. As such, electrical components secured within housing 48 are protected from the atmosphere the engine is operated in while also providing adequate cooling of the components therein. A plurality of mounting bosses 64 extend from housing 48 and are constructed to secure EMM 14 to an engine. Connectors 60, 62 are constructed to be quickly attached to a hose (not shown) such that EMM 14 can be mounted directly to an engine or just as easily in close proximity thereto.

Figure 3:
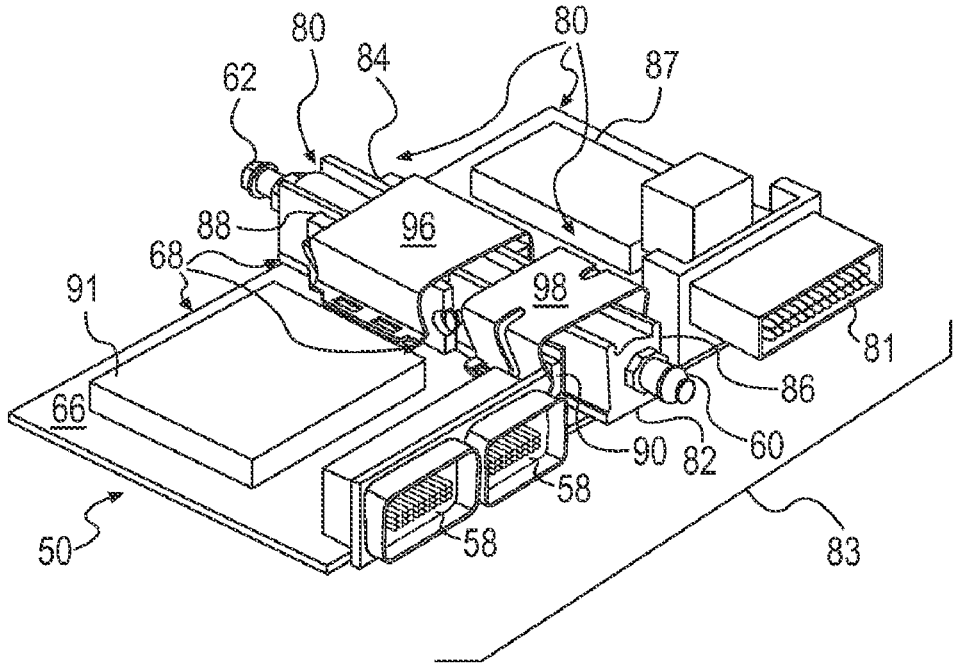
FIG. 3 is a perspective view of the EMM module of FIG. 2 with a cover removed showing an ECU assembly and a voltage regulator assembly.

FIG. 3 shows EMM assembly 50 removed from housing 48 of EMM 14. A first group of electrical components comprising an engine control unit (ECU) 68 is attached to a circuit board 66 and in electrical communication with a first set of connectors 58. A second grouping of electrical components comprising a power regulator and/or voltage regulator 80 is also attached to circuit board 66 and in electrical communication with a second set of connectors 81. A one-piece extruded heat sink 82 is fastened to common circuit board 66 to cool components of both.

In accordance with a preferred embodiment, heat sink 82 is attached to common circuit board 66 transverse to a longitudinal length 83 of common circuit board 66 so as to run between ECU 68 and voltage regulator 80. Heat sink 82 serves to cool components of both ECU 68 and voltage regulator 80.

ECU 68 includes at least one processor having a plurality of control maps as well as a plurality of electrical components to monitor and control engine operation. Preferably, ECU 68 monitors and controls engine systems such as an ignition system, a fuel injection system, an oil system, a cooling system, a diagnostic system, a shift control system, an exhaust valve drive system, a water injection system, an alternator charging system a battery charge system, and the like.

Voltage regulator 80 is configured to regulate and condition power delivered to a plurality of engine components. In accordance with a preferred embodiment, voltage regulator 80 includes a buck converter that is configured to regulate a voltage of an internal rail (not shown) of the engine. The term rail voltage is one used to simply differentiate between different voltages in a system For example, is contemplated that voltage regulator 80 may be configured to receive a high voltage of a first rail, preferably 55 volts DC, and deliver a lower charging voltage, say 12-14 volts DC, to a second rail to charge a battery configuration.

Voltage regulator 80 includes a plurality of highly thermal power components such as a switching regulator 84 and a DC/DC converter 86 in thermal communication with heat sink 82. It is understood that these specific components 84, 86 in thermal communication with heat sink 82 are by way of example only, and additional or substitute components are contemplated. Furthermore, voltage regulator 80 may include any of those electrical components of the EMM that perform power regulation and conditioning. Voltage regulator 80 also includes a plurality of less thermally active components 87 that operate at a lower temperature than the highly thermal components 84, 86 and do not require active cooling. Therefore, these components reside on circuit board 66 at positions removed from heat sink 82.

Similarly, ECU 68 includes a plurality of highly thermal components such as the control circuitry for a fuel injection drive power circuitry 88 and an ignition distribution SCR 90, which are in thermal communication with heat sink 82. Again, it is understood that these specific components 88, 90 that are in thermal communication with heat sink 82, are by way of example only, and additional or substitute components are contemplated. ECU 68 may include any of those electrical components of the EMM that perform control operations. Additionally, ECU 68 includes a plurality of less thermally active components 91 that operate at a lower temperature than highly thermal components 88, 90 and, therefore, reside on circuit board 66 at positions removed from heat sink 82.

It is understood that while the drawings show a preferred embodiment, the components of each circuit may be located at various different locations and may be intermixed between circuits or may cross over the heat sink.

A first clip 96 spans over sink 82, switching regulator 84, and fuel injection drive power circuitry 88 and is constructed to bias both switching regulator 84 and fuel injection drive power circuitry 88 into thermal engagement with heat sink 82. In much the same way, a second clip 98 biases DC/DC converter 86 and ignition distribution SCR 90 into thermal engagement with heat sink 82. In accordance with a preferred embodiment, first clip 96 and second clip 98 are spring clips. This arrangement ensures that the components of ECU 68 and voltage regulator 80, while isolated from one another, are each cooled by a flow of coolant through heat sink 82. As such, excess heat generated by the highly thermal components 84, 86, 88, 90 of ECU 68 and voltage regulator 80 is removed from the EMM 14 before it can thermally pollute EMM assembly 50, or other individual components thereon, such as less thermally active components 87, 91.

Therefore, EMM 14 of the present invention is constructed to incorporate ECU 68 and voltage regulator 80 on common circuit board 66. Furthermore, EMM 14 is configured to receive an extruded heat sink 82. Some of the components of the EMM 14 are maintained in thermal communication 84, 86, 88, 90 with the extruded heat sink 82 whereas other components are separated therefrom 87, 91. Such a construction forms an EMM assembly 50 that is more inclusive of the electrical components of the engine and meets the stringent size, packaging, and weight requirements of modern recreational products.

Therefore, in accordance with one embodiment of the present invention, a control unit assembly includes a housing, at least one processor to control operation of an engine, and a voltage regulator configured to regulate a voltage of at least one rail of the engine. The at least one processing unit and the voltage regulator reside on a common circuit board.

According to another aspect of the present invention, an EMM includes an ECU mounted on a circuit board and configured to control a plurality of systems of a recreational product engine and a voltage regulator mounted on the circuit board and configured to regulate a voltage supplied to at least a number of the plurality of systems of the recreational product engine.

According to yet another aspect of the present invention, an outboard motor includes a powerhead having a combustion engine, a midsection configured for mounting the outboard motor to a watercraft, and a lower unit powered by the combustion engine to propel a watercraft and an EMM assembly. The EMM assembly includes a circuit board, at least one processor controlling engine operation attached to the circuit board, and at least one voltage regulator attached to the circuit board.

The present invention has been described in terms of the preferred embodiment, and it is recognized that equivalents, alternatives, and modifications, aside from those expressly stated, are possible and within the scope of the appending claims.

What is claimed is:

1. A control unit assembly comprising:

a circuit board;

at least one processor to control at least one of a fuel injection system and an ignition system of an engine;

a voltage regulator configured to regulate a voltage of at least one rail of the engine; and a heat sink mounted to the circuit board;

the at least one processor and the voltage regulator both residing on the circuit board in thermal communication with the heat sink.

2. The assembly of claim 1 further comprising a common housing enclosing the at least one processor and the voltage regulator.

3. The assembly of claim 1 wherein the voltage regulator includes a buck converter configured to receive a voltage of a first rail of the engine and supply a charging voltage to a second rail of the engine.

4. The assembly of claim 3 wherein the voltage of the first rail is optimally 55 volts DC and the voltage of the second rail is optimally 12-14 volts DC.

5. The assembly of claim 1 wherein the heat sink is a one-piece extrusion.

6. The assembly of claim 1 wherein the heat sink is mounted to the common circuit board transverse to a longitudinal length of the circuit board.

7. The assembly of claim 1 wherein the at least one processor is on one side of the heat sink and the voltage regulator is on another side of the heat sink.

8. The assembly of claim 1 further comprising a spring clip retaining power components of the at least one processor and the voltage regulator to the heat sink.

9. The assembly of claim 1 wherein the control unit is incorporated into a recreational product.

10. The assembly of claim 9 wherein the recreational product is an outboard motor.

* * * * *